United States Patent [19]

Stenner

[11] Patent Number: 4,651,920

[45] Date of Patent: Mar. 24, 1987

[54] DIRECT MAIL ARTICLE WITH REPLY ENVELOPE AND DETACHABLE REPLY DEVICES VISIBLE WITHIN REPLY ENVELOPE

[75] Inventor: John W. Stenner, Orange, Conn.

[73] Assignee: Kurt H. Volk, Inc., Milford, Conn.

[21] Appl. No.: 679,951

[22] Filed: Jan. 15, 1985

Related U.S. Application Data

[62] Division of Ser. No. 419,224, Sep. 17, 1982, Pat. No. 4,543,082.

[51] Int. Cl.[4] ..... B65D 27/00

[52] U.S. Cl. ..... 229/70; 229/72; 229/73; 229/92.1

[58] Field of Search ..... 229/70, 73, 92.1, 92.5, 229/92.7, 72

[56] References Cited

U.S. PATENT DOCUMENTS

| | | | |
|---|---|---|---|
| 3,167,243 | 1/1965 | Wiley | 229/73 |
| 3,356,286 | 12/1967 | Greason | 229/70 |
| 3,399,823 | 9/1968 | Johnson | 229/72 |
| 3,467,299 | 9/1969 | Meyer | 229/70 |
| 3,557,519 | 1/1971 | Lyon, Jr. | 493/216 |
| 3,807,771 | 4/1974 | Greason | 229/73 X |
| 3,845,698 | 11/1974 | Scholle | 229/927 |
| 4,067,171 | 1/1978 | Herbert et al. | 493/216 |
| 4,093,117 | 6/1978 | Morse | 229/70 |
| 4,201,332 | 5/1980 | Wooten | 229/73 X |
| 4,284,230 | 8/1981 | Schultz | 229/73 |
| 4,437,852 | 3/1984 | Volk, Jr. et al. | 493/216 |

FOREIGN PATENT DOCUMENTS

| | | | |
|---|---|---|---|
| 85876 | 10/1919 | Switzerland | 229/73 |

*Primary Examiner*—William Price
*Assistant Examiner*—Bryon Gehman
*Attorney, Agent, or Firm*—Thomas E. Spath

[57] ABSTRACT

Direct mail articles comprise an outer envelope containing a pre-formed reply envelope, detachable reply devices, such as coupons and a reply card, and optionally, one or more separate enclosure sheets. The reply envelope is provided with a plurality of apertured pockets adapted to receive at least one of the reply devices, where the apertures permit visual or machine sorting of the sealed envelopes based on the presence or absence of a particular reply device in a particular pocket. Methods of preparing personalized, finished articles from one or more integral sheets or webs are described.

17 Claims, 13 Drawing Figures

DIRECT MAIL ARTICLE WITH REPLY ENVELOPE AND DETACHABLE REPLY DEVICES VISIBLE WITHIN REPLY ENVELOPE

This application is a division of Ser. No. 419,224 filed Sept. 17, 1982, now U.S. Pat. No. 4,543,082.

BACKGROUND OF THE INVENTION

1. Field of the Invention

This invention relates to direct mail articles comprising an outer envelope containing a pre-formed reply envelope and a plurality of detachable reply coupons designed to be selectively inserted into the reply envelope by the recipient, and to methods for their manufacture. The articles and their methods of manufacture are especially adapted to personalization of one or more of the enclosures.

2. Description of the Prior Art

The method described herein is particularly suited for commercial production of printed articles such as advertisements, solicitations, and the like, in which the printed content is, for the most part, the same, and where tens of thousands, or even millions of articles are mailed. It is common for such mailings to include a postage paid business reply envelope and a coupon, token or other form of reply device to encourage a favorable and prompt acceptance of the merchandise offer.

Large volume mailings of this type are often "personalized." A direct mail article is personalized when information unique to the recipient is printed on the article and/or on its enclosures. Forms of personalization include the recipient's name, address, sex, age, account or billing number, and other pertinent information. The personalized information can be reproduced in the form of conventional alpha-numeric characters readable by the eye or by electronic optical character recognition devices, or by indicia adapted to be read by appropriate computer peripheral equipment, such as bar codes and the like.

Typically, solicitations for magazines, books or other merchandise provide the recipient who accepts the offering with the alternative of returning payment with the order or of being billed later. Periodical subscriptions of different lengths are commonly offered to new subscribers. A selection of one or more books or other types of merchandise are often offered, requiring the purchaser to enter his choice on a card or other reply device. It is also known to provide coupons identifying the merchandise with the solicitation, and the recipient makes known his choice by selecting and returning the coupon(s) in the business reply envelope. In order to process the orders using any of the methods known to the prior art it was necessary to have personnel open the reply envelopes, read and record the pertinent information pertaining to the order and indicate whether payment was enclosed or whether the customer was to be billed. This manual processing was time-consuming, and therefore expensive, and provided the opportunity for clerical errors. In the case of large volume mailings, the steps of opening the envelopes, removing the reply devices and making a record of its contents require large numbers of personnel to process the orders in a reasonable period of time.

SUMMARY OF THE INVENTION

The present invention relates to direct mail articles comprising a business reply envelope having a plurality of pockets, each of which pockets contains an aperture, and one or more detachable reply devices adapted to be inserted into said pockets, where the detachable reply devices are printed with differentiating indicia which are visible through said pocket apertures. In a preferred embodiment, the interior of the reply envelope opposite the apertures is printed with a contrasting field which is visible through the aperture when the pocket is empty, and which contrasting field is masked when a reply device or other material is inserted in the pocket.

In a further preferred embodiment, the novel reply envelope and detachable reply devices comprise the contents of an outer mailing envelope all of which have been prepared from an integral sheet or web.

In another preferred embodiment, the reply envelope and one or more of the reply devices are personalized in a form that is readable by electronic optical character recognition means. In addition, the reply devices are provided with alpha-numeric characters, bar codes or the like which, when inserted in the envelope pocket are visible through the pocket aperture and are also readable by electronic means adapted for sorting.

The preferred method of manufacture provides a pre-formed and completely made-up reply envelope simultaneously with the production of the outer envelope, reply devices, or as referred to hereafter reply coupons and reply card, and, optionally, other enclosures, which can be personalized without the risk of mismatching.

In a further preferred embodiment the reply envelope is manufactured with at least one pocket adapted to retain a reply coupon, which pocket is provided with an aperture to permit inspection of its interior even after the reply envelope is sealed. The flap of the reply envelope can be provided with remoistenable gum adhesive.

This preferred method of manufacture facilitates computer directed personalization of the outer envelope, the reply envelope, the reply coupon or coupons, and of the other enclosures, if any. The invention allows a variety of enclosures to be formed in the manufacture of the article.

In one embodiment of the present invention, the article to be produced is made from a composite sheet comprising an outer envelope sheet defining a flap, a front panel and a rear panel. Integral with this outer envelope sheet is a reply device joined along a first transverse line to the outer envelope rear panel. At least a portion of the reply device defines one or more detachable reply coupons and optionally, a reply card, the configuration and purpose of which will be described in greater detail below. Integral with the reply device is a reply envelope sheet defining a flap, a front panel and a rear panel. The front and rear panels are divided along one or more longitudinal lines to define one or more fields for reply coupon pockets. An aperture is provided within each reply coupon pocket field. The reply envelope sheet is joined along a second transverse line to the reply device.

In another embodiment of the present invention, the article can be manufactured with enclosures in addition to, or in lieu of, the reply device. In the case where the reply device is eliminated, one of the enclosures can define the desired number of selective reply coupons.

The method described herein is particularly advantageous for preparing large numbers of enclosures and reply envelopes, each of which is imprinted with one or more personalized messages. The use of personalized messages in connection with commercial solicitations is believed to improve the likelihood of obtaining a favorable response from the recipient.

Moreover, the present invention allows the originator upon receipt of the reply envelope to quickly and efficiently determine the information transmitted by the recipient without actually having to open the reply envelope. A solicitation system taking advantage of this feature is described presently.

For this solicitation system, a reply envelope is manufactured in accordance with this invention with two selective reply coupon pockets, each adapted for insertion and retention of a selective reply coupon. The enclosure pocket is made larger than each of the reply coupon pockets so that it can hold a payment check and optionally, a reply card, inserted by the recipient. The reply coupon pockets and the enclosure pocket are each provided with an aperture that allows viewing the contents of the pocket after the reply envelope is sealed. Additionally, the areas inside of the reply envelope which are visible through the respective apertures are printed with contrasting field, preferably darkened, as with black ink, for reasons to be described presently. The reply envelope is also personalized with the name and address of the recipient.

The article is also manufactured in accordance with this embodiment of the invention with four selective reply coupons. Where magazine subscriptions are being solicited, each selective reply coupon can represent a particular subscription period. For example, the four reply coupons can represent subscription periods of six months, one year, eighteen months, and two years, respectively. The reply coupons are visually contrasted from each other by printing, as with a different color ink or a different ink pattern, to signify the intended subscription period. These colors or patterns are also visually contrasted from the darkened interior fields of the reply coupon pockets that are visible through the apertures by being lighter in color.

The reply envelope can be provided with a printed message that tells the recipient that insertion of a reply coupon in one particular reply coupon pocket indicates a desire to be billed for the subscription at a later date, while insertion in the other reply coupon pocket indicates that payment is enclosed. In the latter instance, the recipient inserts payment, as by check, in the enclosure pocket of the reply envelope. The reply card, adapted to be inserted in the enclosure pocket, can be used to communicate additional information, such as a change of address.

The recipient selects an appropriate subscription period by choosing a particular detachable reply coupon and inserting it in the designated reply coupon pocket, by which he indicates whether he wishes to be billed later or has included payment. The recipient then seals and mails the reply envelope to the originator's subscription fulfillment department or to a service that specializes in subscription services for publishers.

Upon receipt of the reply envelope, the following information can be determined without opening the reply envelope: the recipient's name, since the reply envelope was personalized in the manufacturing process; the desired subscription length, since the color or ink pattern of the enclosed selective reply coupon is visible through the aperture of the pocket in which the reply coupon is contained; whether the order is to be billed later or payment is enclosed, depending upon which reply coupon pocket the reply coupon is visible in; and, in fact, whether payment has or has not been enclosed, since the check, if enclosed, will be visible through the aperture in the enclosure pocket. Since those portions of the reply coupon pockets that are visible through their apertures are visually contrasted from the reply coupons, the determination of whether a reply coupon is present or absent from a reply coupon pocket is readily made. Since the portions of the enclosure pocket visible through its aperture are darkened, the presence or absence of a reply coupon or payment check can be determined faster.

This invention is a further improvement over the method previously disclosed and claimed in U.S. Pat. No. 3,557,519 issued Jan. 29, 1971, which describes a method for producing an envelope containing a letter sheet from an integral sheet or web of paper. This invention is also a further improvement over the method previously disclosed and claimed in patent application Ser. No. 330,320, filed Dec. 14, 1981 now U.S. Pat. No. 4,437,852 issued Mar. 20, 1984, which describes a method for preparing an envelope containing at least one pre-printed enclosure and a pre-formed reply envelope. Also pertinent is the disclosure of U.S. Pat. No. 4,067,171, issued Jan. 10, 1978 which describes a method for preparing an envelope containing a plurality of enclosure sheets. The methods disclosed in the foregoing patents permit large volume mailings of personalized articles while eliminating the possibility of mismatching.

The teachings and disclosures of both U.S. Pat. Nos. 3,557,519 and 4,067,171 and application Ser. No. 330,320 now U.S. Pat. No. 4,437,852 are incorporated herein by reference. In the practice of the inventions claimed in Ser. No. 330,320, now U.S. Pat. No. 4,437,852 as well as in the practice of other methods known to the prior art for preparing solicitations and billings containing reply envelopes, the construction of the reply envelope is such that it is necessary to open the reply envelope in order to determine its contents. In the case of large volume mailings, these steps of opening the envelope, removing the reply device and determining its content are time-consuming and expensive, because of the personnel required.

The methods described herein can be readily adapted to produce articles in a variety of sizes and formats which are within the capabilities of commerical lithographic and computer directed printers and the folding and converting equipment which is available in the art.

The present invention, and its various embodiments, will be described in greater detail below. Additional specific uses and advantages of the various formats which can be embodied in the methods and article of the invention herein will be apparent to those familiar with the art in view of the teachings of this specification.

DESCRIPTION OF THE PREFERRED EMBODIMENTS

Figure 1:
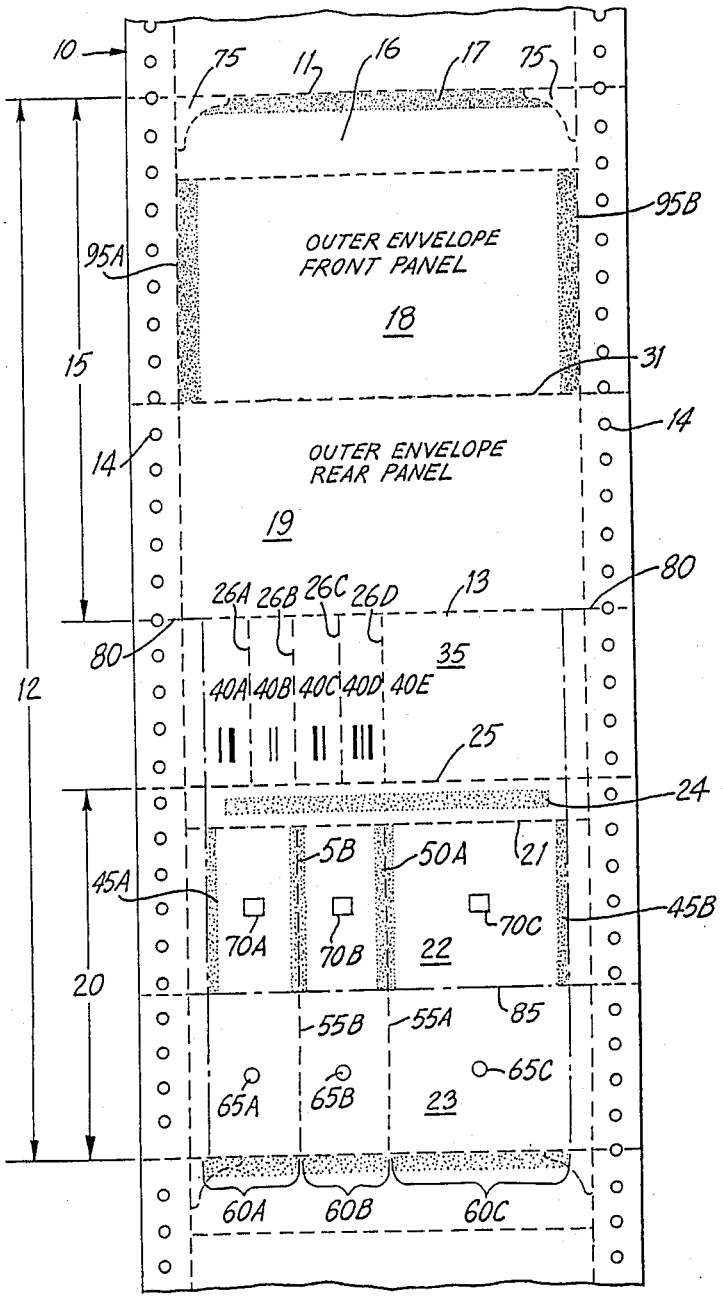
FIG. 1 is a plan view showing a section of continuous paper web containing an outer envelope sheet, a reply device that in part defines a plurality of selective reply coupons, and a reply envelope sheet.

Referring to the drawings in detail wherein like reference characters designate corresponding parts throughout the several figures, and particularly to FIG. 1, there is shown web 10 which is divided by perforated transverse separation lines 11 into repeating composite sheets 12.

Web 10 is a continuous web form having line holes 14 that are engaged by a computer directed printer. This permits high speed feeding and proper indexing of the forms for personalization, and facilitates the bursting operation described below. Web 10 is optionally provided with perforations along first transverse line 13, to facilitate fan folding along this line.

As shown in FIG. 1, composite sheet 12 contains an outer envelope sheet 15 defining a flap 16, to which a remoistenable gum adhesive 17 can be applied. Composite sheet 12 also contains a reply device 35 and a reply envelope sheet 20.

Reply envelope sheet 20 defines a flap 21, to which a remoistenable gum adhesive 24 can be applied. Also defined by reply envelope sheet 20 is reply envelope front panel 22 and reply envelope rear panel 23.

Outer envelope rear panel 19 is integrally joined along first transverse line 13 to reply device 35. In turn, reply device 35 is integrally joined to reply envelope sheet 20 along second transverse line 25.

A portion of reply device 35 is shown divided along longitudinal lines 26A, 26B, 26C and 26D to define four selective reply coupons, namely, 40A, 40B, 40C and 40D and an optional reply card 40E, which can be used for special instructions. Lines 26A–26D can be perforated to facilitate removal by the recipient. Likewise, perforation of second transverse line 25 further facilitates removal of selective reply coupons 40A–40D, and generally facilitates removal of the reply device 35 from reply envelope flap 21.

The article of the present invention is particularly useful in soliciting subscriptions to magazines or other periodicals. For example, detachable reply coupons 40A–40D can be printed in different colors and with different legends to indicate the length of the various subscription periods being offered. It is preferable to print the color associated with each subscription period on both sides of the particular reply coupon to insure that the reply coupon color will be displayed regardless of the manner in which it is inserted into a reply coupon pocket.

The detachable reply coupons 40A–40D are intended to be retained in reply coupon pockets that are part of the reply envelope after manufacture. Referring to FIG. 1, reply envelope panels 22 and 23 are shown divided along longitudinal lines 55A and 55B to define reply coupon pocket fields 60A and 60B, as well as enclosure pocket field 60C. The transverse separation between the left-most edge of reply envelope sheet 20 (as shown in FIG. 1) and longitudinal line 55B is sufficient to allow easy insertion of any of reply coupons 40A–40D into the reply coupon pocket formed from field 60A after manufacture, yet not so great as to allow significant movement of a coupon after insertion. The transverse separation between longitudinal lines 55B and 55A is spaced similarly.

In this particular embodiment, those portions of fields 60A, 60B, and 60C that are contained within reply envelope rear panel 23 are provided respectively with apertures 65A, 65B, and 65C. After manufacture of the reply envelope, these apertures 65A–65C make visible the contents of their respective pockets even after the reply envelope is sealed. While in the embodiment shown, apertures 65A–65C are circular, any convenient shape can be used. Additionally, while apertures 65A–65C are shown on rear panel 23, they can also be placed on front panel 22 provided that they do not interfere with mailing and return addresses printed on front panel 22.

Those areas of the pocket interior of the envelope that are opposite the apertures can be provided with darkened fields, as by printing with black ink. Accordingly, darkened fields 70A, 70B and 70C are positioned within pockets 60A–60C on reply envelope front panel 22 so that when the reply envelope rear panel is superposed over, and bonded to the reply envelope front panel, only darkened fields 70A–70C will be visible through apertures 65A–65C. These darkened fields should contrast sharply with the colors or other differentiating indicia printed on reply coupons 40A–40D, thereby facilitating visual determination of the presence or absence of a selective reply coupon in a reply coupon pocket, and further facilitating determination of the presence or absence of a check or reply card enclosure pocket 60C.

In the method of this invention, blank web 10 is fed into a form printer, such as a flexigraphic, lithographic, gravure, or letter press. Each of these presses can print, for example, form messages appropriately positioned to lie within the field of reply device 35 on web 10. This form printer can also print the reply mailing address on reply envelope front panel 22 and, optionally, a return postage mailing permit and any form message which the sender desires to have within the fields of reply envelope front panel 22 or rear panel 23. It is at this stage that colors or other indicia are printed on reply coupons 40A, 40B, 40C, and 40D, and dark portions of fields 70A–70C are printed in appropriate positions on reply envelope front panel 22. Both sides of the outer and reply envelope sheets and the reply device can be printed, if desired, as is preferred for the colors of reply coupons 40A–40D.

Referring to FIG. 1, die cutting operations can be performed on the form printer. For example, apertures 65A, 65B, and 65C can be die cut at this time. Also, triangular portions 75 can also be die cut and removed on the form printer to provide the desired tapering configuration to the envelope flap 16. Finally, shoulders 80, between reply device 35 and outer envelope rear panel 19, are die cut to facilitate subsequent bursting steps described below.

After exiting from the form printer, web 10 is next indexed and fed into computer directed printers for personalization. Conventionally, outer envelope front panel 18 of envelope sheet 15 will be printed with the name and address of the recipient. Selective reply coupons 40A, 40B, 40C and 40D can also be personalized as by printing thereon the recipient's name. Alternatively, selective reply coupons 40A–40D can be printed with coded information that can be read only by appropriate computer peripheral equipment, such as bar codes or the like. Finally, the recipient's reply address can be entered either on reply envelope front panel 22 or reply envelope flap 21. It is also possible to include a unique customer or account number, or other personalized information.

Web 10 is next subject to a line hole slitting and removal operation. Specifically, those portions of composite sheet 12 that lie outside the fields of outer envelope sheet 15, reply device 35, and reply envelope sheet 20 are removed. Line hole slitting and removal preferably is accomplished by appropriately positioned slitting apparatus that makes the necessary longitudinal cuts. The longitudinal edge portions of web 10, which contain the line holes, are then removed. The burster also separates, or "bursts," web 10 along transverse cutting lines 11 to define individual composite sheets 12.

Figure 2:
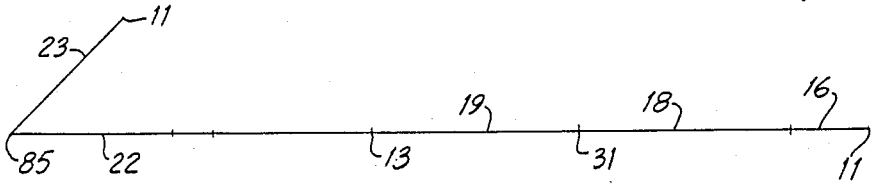
FIG. 2 is a schematic side view showing the first folding step for the embodiment of FIG. 1 after die-cutting and bursting from the continuous paper web.
Figure 3:
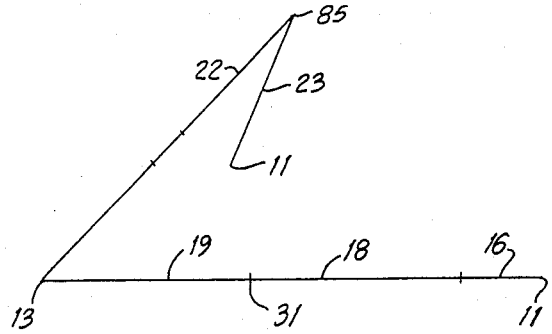
FIG. 3 is a schematic side view of the elements shown in FIG. 2, illustrating the partially completed second folding step.
Figure 4:
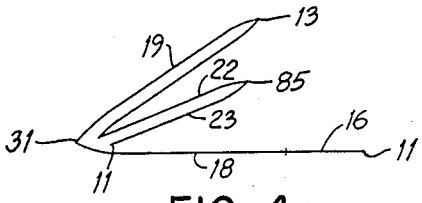
FIG. 4 is a schematic side view of the elements shown in FIG. 3, illustrating the partially completed third folding step.

Following bursting, the individual composite sheets 12 are separately fed into a conventional multiplate folding machine, wherein three transverse folds are made. The sequence and direction and the folds are illustrated in FIGS. 2, 3 and 4.

Prior to making the first fold, beads of adhesive 45A and 45B are applied inwardly of each opposite longitudinal edge of either reply envelope front panel 22 or rear panel 23. Additionally, beads of adhesive 50A and 50B are coincidentally applied on longitudinal lines 55A and 55B on either reply envelope front panel 22 or rear panel 23. It is preferable to apply all of the foregoing adhesive beads on reply envelope front panel 22, as shown in FIG. 1.

After application of adhesive, reply envelope rear panel 23 is folded to superposed position over panel 22 along transverse fold line 85. This folding step is shown in FIG. 2. In the embodiment of FIG. 2, the position of fold line 85 is somewhat less than one-third of the distance between separation line 11 and second transverse line 25. This fold line position is prefered since it prevents further folding in the subsequent folding step of the free end of reply envelope rear panel 23, as illustrated in FIG. 4.

Prevailing United States Postal Service regulations will dictate to some degree the position of reply envelope transverse fold line 85, since an envelope must meet a certain minimum dimensions to be accepted for delivery. The distance between reply envelope flap fold line 90 and reply envelope transverse fold line 85 should be selected in order to comply with such regulations. Subject to this consideration, suitable positions for folding line 85 will be apparent to those skilled in the art after reading the description of this specification.

Upon folding, reply envelope rear panel 23 is superposed and brought into overlying alignment with reply envelope front panel 22, apertures 65A, 65B and 65C also being brought into overlying alignment with darkened fields 70A, 70B, and 70C, respectively. Pressure is then applied to seal the opposite edges to form a reply envelope pocket, and to seal such portions of reply envelope front and rear panels 22 and 23 as are in contact with beads 50A and 50B to form, in this embodiment, two reply coupon pockets and one reply correspondence pocket.

As shown in FIG. 3, composite sheet 12 is next folded along first transverse line 13. As this second fold is made, the opposite longitudinal edges of reply envelope front and rear panels 22 and 23 and reply device 35 are trimmed off, as by a cutting wheel. Since adhesive beads 45A and 45B were applied inwardly of the edges that were trimmed, the reply envelope pocket remains intact subsequent to trimming.

As will be appreciated by one familiar with the apparatus employed in the art, the various steps described above can be combined or rearranged in order to accomodate the format of the composite sheet and the capabilities of the equipment available.

In the next step, beads of adhesive 95A and 95B are applied along the opposite longitudinal edges of the inside of either outer envelope front panel 18 or rear panel 19, and the panel edges are brought into overlying alignment and pressure is applied to seal the opposite edges to form the outer envelope pocket containing the enclosures. It is preferred that the adhesive be applied to the opposite edges of outer envelope front panel 18, as illustrated in FIG. 1.

In the final step, outer envelope rear panel 19 is separated from reply device 35 along first transverse line 13. This separation operation can be performed by trimming such exposed edges as appear behind the front panel of the envelope sheet. Final trimming in such a manner is performed by a slitting device comprising scissor slitting wheels 155, which are adjusted to the thickness of the paper stock, to trim away portions of outer envelope rear panel 19 and reply device 35 that lie adjacent to fold line 13. The paper to be trimmed is made accessible to the slitting device by means of a deflector 150, which temporarily bends down outer envelope flap 16. The edges of the above-identified materials can then be passed into slitting wheels 155 for trimming.

Figure 13:
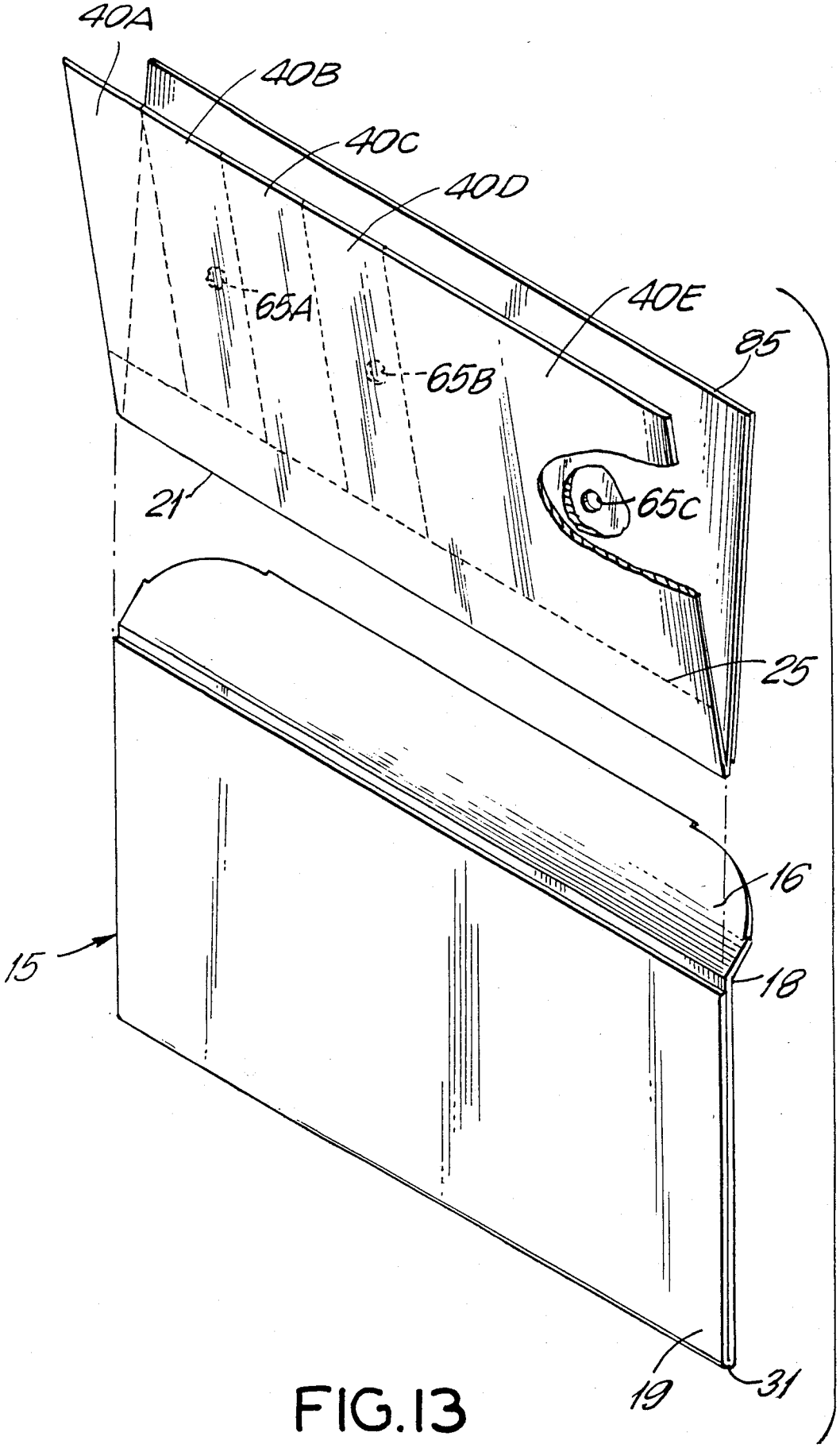
FIG. 13 is a partially sectioned, exploded perspective view of the fully constructed assembled outer envelope and the folded reply device and reply envelope of FIG. 1.

As a result of the final separation or trimming, this particular embodiment of the method of this invention results in a personalized envelope containing a reply device comprising four detachable reply coupons, and a pre-formed reply envelope, detachably connected to the reply device, which contains two reply coupon pockets and a larger correspondence pocket, as illustrated in FIG. 13.

While the foregoing embodiment discloses four reply coupons and two reply pockets, the method can be adapted to provide greater or fewer reply coupons or reply envelope pockets.

The foregoing embodiment is adapted for use in processing magazine subscription orders as follows, it being understood that the reply envelope has been personalized with the recipint's name and address. Upon receipt of a sealed reply envelope, the apertures are scanned, and envelopes containing payment checks in the correspondence pocket 60C are sorted out for the manual folding and accounting. The remaining envelopes are scanned and collated on the basis of the indicia appearing through the aperture, and/or on the presence or absence of a coupon masking the dark field behind the respective apertures. This scanning and collating can be done either by relatively unskilled personnel, or preferably by machine. If the sorting is done manually, the portion of the coupon visible through the aperture indicates the length of subscription desired and the sorted reply envelopes can be fed to an electronic optical character reader, or OCR, for compilation of appropriate mailing and billing lists. In a preferred embodiment each subscription coupon is printed with a different bar code which can be read by electronic means in conjunction with an OCR to automatically sort and compile the subscribers list for subsequent billing. As an alternative to using bar codes, a simpler photoelectric device can be used to determine whether the darkened field behind a coupon aperture has been masked by a coupon inserted by the recipient, thereby indicating the length of the subscription selected. The envelopes are thereby sorted and fed to the OCR as in the manual handling method described above. The electronic and electromechanical devices for reading and sorting on the basis of the printed indicia are known to the art and do not form a part of this invention.

As will be understood by those familiar with the art, the novel articles and methods of the invention will facilitate the rapid handling of orders and reduce the number of personnel required to process such orders. Moreover, the use of electronic scanning means in conjunction with the optical character readers will result in fewer clerical and accounting errors to the benefit of both the publisher and the subscribers.

Another embodiment of the present invention permits inclusion of enclosures with the reply envelope. The selective reply coupons can be defined either on the enclosures or on an optionally included reply device. This embodiment is produced from two webs, as described presently.

Figure 6:
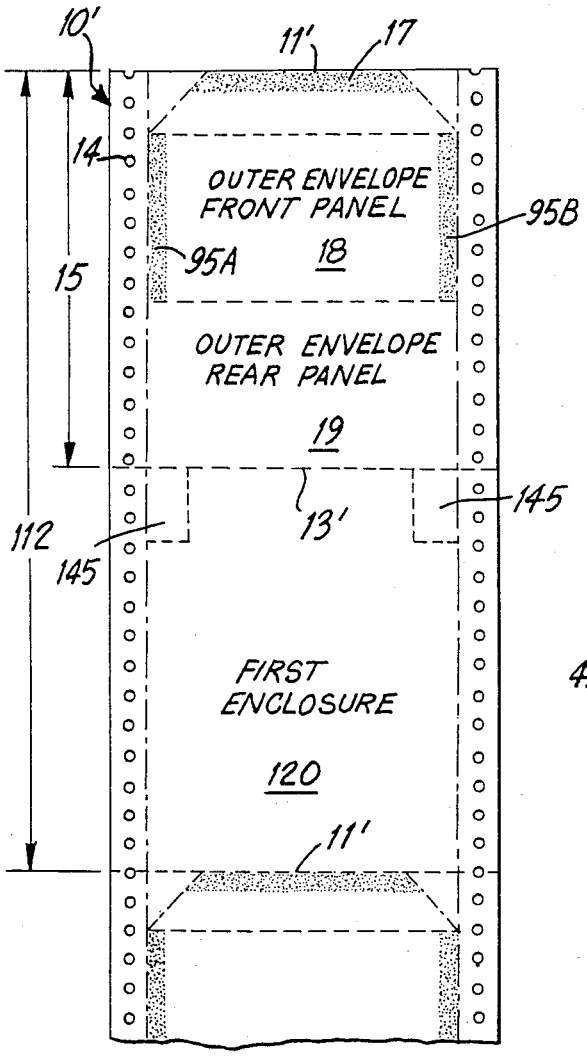
FIG. 6 is a plan view showing a section of continuous paper web containing an outer envelope sheet and a first enclosure.
Figure 7:
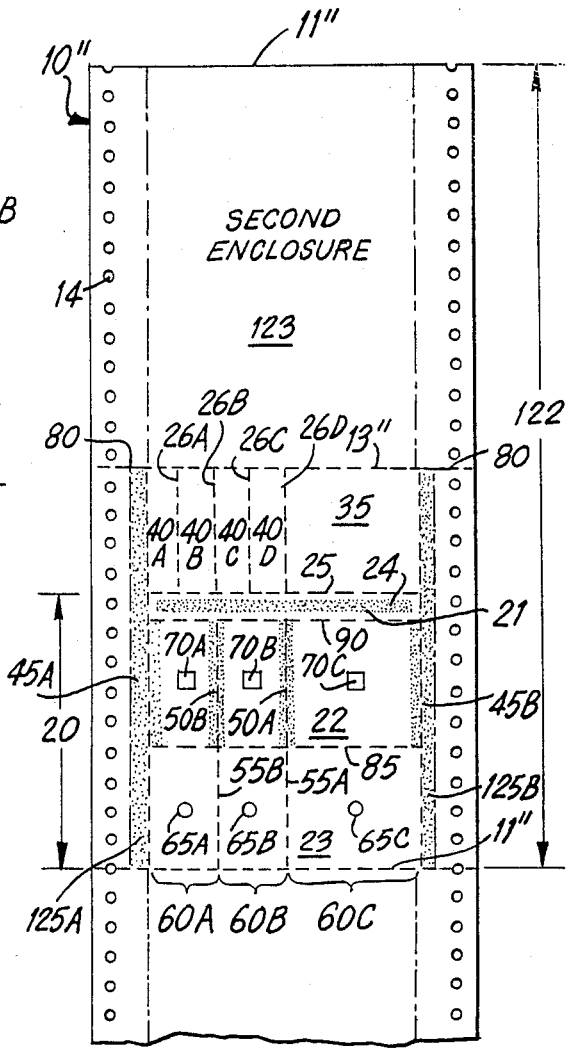
FIG. 7 is a plan view showing a section of continuous paper web containing a second enclosure, a reply device, and a reply envelope sheet.

Referring to FIG. 6, there is shown web 10' containing outer envelope sheet 15 as before, to which is integrally attached along transverse folding line 13' a first enclosure 120. Referring to FIG. 7, there is shown a web 10" defining a second enclosure 123, to which is integrally attached along fold line 13" reply device 35 and reply envelope sheet 20. As before, reply device 35 defines the selective reply coupons, and reply envelope sheet 20 is divided along longitudinal line 55A and 55B into reply pocket fields 60A and 60B and enclosure pocket field 60C.

Referring to FIGS. 6 and 7, the distance between the longitudinal edges of reply envelope sheet 20 is equal to that of outer envelope sheet 15 and first enclosure 120. Outer envelope sheet 15 and second enclosure 123 on respective webs 10' and 10" are the same length. Likewise, first enclosure 120 is the same length as the aggregate length of reply envelope sheet 20 and reply device 35. Thus, by properly indexing the pre-printed webs 10' and 10", as by use of the line holes 14, the composite sheets 112 and 122 can readily be aligned in a superposed configuration with reply device 35 and reply envelope sheet 20 over first enclosure 120, and second enclosure 123 over outer envelope sheet 15. When sheets 112 and 122 are superposed in such a configuration, they can thereafter be moved as a unit.

Webs 10' and 10" are each fed into form printers, which perform the same functions as before, and also can print form letters on enclosures 120 and 123. In addition, the form printer also die-cuts and removes portions 145 shown in FIG. 6. Their removal lessens the chance of the subsequent trimming operation leaving unsightly notches in outer envelope rear panel 19.

Personalization is accomplished as described above. For example, if first enclosure 120 is in a letter format, the name and address can be entered and a personal salutation printed, along with other desired personal data references in the body of the letter. Second enclosure sheet 123 be personalized.

After webs 10' and 10" exit the computer directed printers, beads or spots 125A and 125B of liquid adhesive or hot melt adhesive are applied adjacent the opposite longitudinal edges of either first enclosure 120 or reply envelope sheet 20. The position of these beads or spots 125A and 125B are shown in FIG. 7. Alternatively, beads or spots 125A and 125B can be applied to a more limited area of either enclosure 120 or sheet 20. For example, it is sufficient to apply spots 125A and 125B only to the lower left portion of reply envelope rear panel 23.

After application of the adhesive, webs 10' and 10" are brought into an aligned superposed configuration for mating. They are then pressed together so that they are joined and bonded by means of the adhesive beads or spots 125A and 125B. Alternatively, instead of using a separately applied adhesive, bonding can be accomplished by passing composite sheets 10' and 10" through crimping wheels or other crimping means which are known in the art.

Composite sheets 112 and 122 remain joined together during subsequent steps and through one of the folding operations. The joining of composite sheets 112 and 122 together entirely eliminates any risk of a subsequent mismatching and its attendant waste, and reduces greatly the need for quality control checks on the finished product.

Furthermore, this method of joining composite sheets 112 and 122 substantially eliminates shifting and misalignment during the high speed folding steps.

Mated and glued webs 10' and 10" are next subject to a line hole slitting and removal operation. Specifically, those portions of composite sheet 112 lying outside the field of envelope sheet 15 and first enclosure 120 are removed. In a similar manner, those portions of composite sheet 122 which lie outside the fields of second enclosure 123, reply device 35 and reply envelope sheet 20 are removed.

Figure 8:
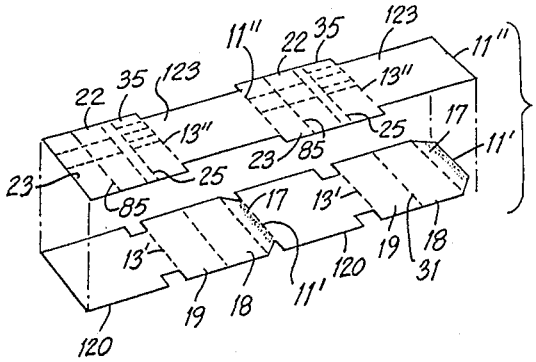
FIG. 8 is a exploded perspective view illustrating the alignment for mating of two of the partially processed composite sheets from the continuous webs of FIGS. 6 and 7.

Line hole slitting and removal preferably is accomplished by appropriately positioned slitting apparatus that makes the necessary longitudinal cuts. The longitudinal edge portions of webs 10' and 10" which contain the line holes, are then removed. FIG. 8 illustrates, in an exploded perspective view, sections of webs 10' and 10'', comprising adjacent composite sheets following the line hole cutting and removal operation and prior to bursting.

Next, the mated sheets are separated along transverse lines 11' and 11''.

Figure 5:
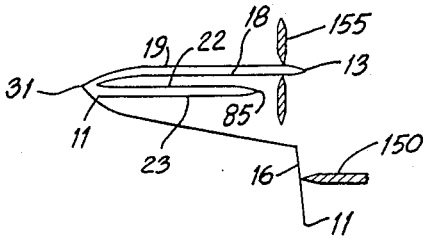
FIG. 5 is a schematic side view showing the steps of simultaneously separating and trimming the reply device from the outer envelope rear panel.
Figure 9:
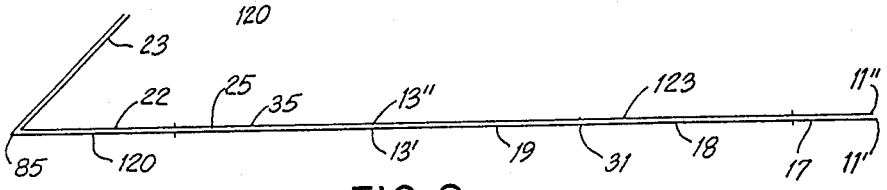
FIG. 9 is a schematic side view showing the first folding step partially completed on the aligned and joined integral outer envelope and first enclosure and integral second enclosure, reply device and reply envelope sheet, after die-cutting and bursting from the continuous paper web.

Following bursting, the individual composite sheets 112 and 122, joined together by beads or spots 125A and 125B, are fed into a conventional multiplate folding machine, wherein three transverse folds are completed in the sequence and direction of the folds comparable to that illustrated in FIGS. 5, 6 and 7. Adhesive is first applied to define a plurality of separate pockets in the reply envelope. Next, reply envelope rear panel 23 is folded towards reply envelope front panel 22 along transverse fold line 85. In this embodiment, a portion of first enclosure 120 is also folded at the same time, to produce the configuration shown in FIG. 9.

Figure 11:
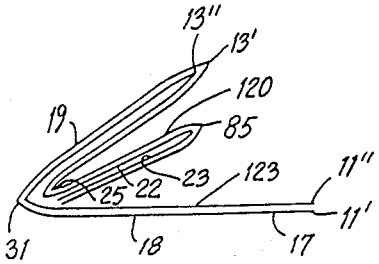
FIG. 11 is a schematic view of the elements shown in FIG. 10, illustrating the partially completed third folding step.
Figure 12:
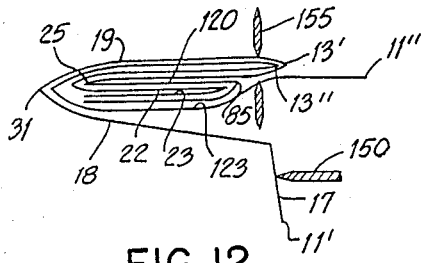
FIG. 12 is a schematic side view showing the steps of simultaneously separating and trimming the enclosures and the top edge of the rear envelope panel.

Upon folding, reply envelope front and rear panels 22 and 23 are superposed and brought into overlying alignment, and pressure is applied to form the reply envelope pocket and reply coupon pockets. For illustrative purposes only, FIGS. 10 through 12 show reply envelopes front and rear panels 36 and 37 as separate panels, even though they are sealed to form a reply envelope pocket, so that the structure produced by the present method can be described with clarity.

Figure 10:
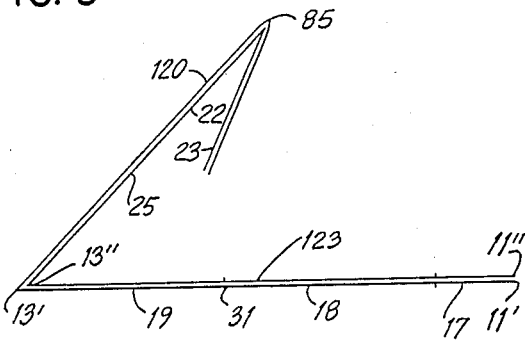
FIG. 10 is a schematic side view of the elements shown in FIG. 9, illustrating the partially completed second folding step.

As shown in FIG. 10, mated and joined composite sheets 112 and 122 are next folded along transverse fold lines corresponding to fold lines 13' and 13'', respectively. As this second fold is made, the opposite longitudinal edges of first enclosure 120, and the reply envelope pocket made from reply envelope front panel 22 and rear panel 23 are trimmed off, as by a cutting wheel. As a result of this trimming operation, the transverse width of the reply envelope pocket is approximately equal to that of second enclosure 123. Since adhesive beads 45A and 45B are applied inwardly of the edges that were trimmed, the reply envelope pocket remains intact subsequent to trimming.

As will be understood with reference to the above description, the foregoing trimming operation completely removes those portions of the sheets that were glued together to hold the sheets in a mated aligned superposed configuration. However, no undesirable shifting or misalignment results from subsequent processing, because the two previous folds result in composite sheets 112 and 122 being in a securely nested configuration.

Prior to the final folding step, beads of adhesive 95A and 95B are once again applied along the opposite longitudinal edges of the inside of either outer envelope front or rear panel 18 or 19, and the panel edges are brought into overlying alignment and pressure is applied to seal the opposite edges to form the outer envelope pocket containing the various enclosures.

Finally, the folded first enclosure 120 is separated from the outer envelope rear panel 19 along line 13' and second enclosure 123 is separated from reply device 35 along 13''. These separation operations can advantageously be combined into a single step with the final trimming of the exposed edges that appear behind the front panel of the envelope sheet. In this trimming step, any portion of second enclosure 123 which overlaps flap 16 is removed so that the finished envelope can be sealed. Trimmed cleanly away in this final operation are both ends of second enclosure 123; portions of first enclosure 120 and outer envelope rear panel 19 lying adjacent to fold line 13'; and the portion of reply device 35 lying adjacent to fold line 13''. The paper to be trimmed is made accessible to the slitting device by means of a flap deflector 50, which temporarily bends down outer envelope flap 16. The edges of the above-identified materials can then be passed into slitting wheels 55. This step is illustrated schematically in FIG. 12, in a cutaway sectional view showing the enclosures and upper edge of rear envelope panel 19 being engaged by scissor wheels 55, while flap 16 is held out of the way by flap deflector 50.

A variation of the embodiment just described involves eliminating reply device 35 and lengthening second enclosure 123 to be joined with reply envelope sheet 20 along the top edge of reply envelope flap 21. In this configuration, reply devices can be defined either in first enclosure 120, second enclosure 123, or in both.

As will be appreciated by one skilled in this art, adaptations of formats and uses for the articles and methods described can be made which will be within the spirit and scope of the invention.

I claim:

1. An article of manufacture suitable for mailing comprising an outer envelope containing a separate sealable reply envelope, the reply envelope having a flap, a front and a rear panel, and a plurality of detachably connected reply devices, the reply envelope provided with a plurality of pockets adapted to receive at least one of the reply devices, and each of the pockets containing an aperture communicating with its interior to permit inspection thereof when the reply envelope is sealed.

2. The article of claim 1 in which the reply devices are detachably connected to the reply envelope flap.

3. The article of claim 1 in which each of the reply devices is printed with differentiating indicia which are visible through a pocket aperture when inserted in the pocket.

4. The article of claim 3 in which the differentiating indicia are bar codes.

5. The article of claim 3 in which the differentiating indicia comprise alpha-numeric characters.

6. The article of claim 3 in which the differentiating indicia comprise contrasting colors.

7. The article of claim 1 in which the inner surfaces of the panel of the reply envelope pockets opposite the apertures contain a printed field which is visible through the aperture and contrasts with the outer surface of the apertured panel.

8. the article of claim 7 in which the printed field is darker than the outer surface of the apertured panel.

9. The article of claim 1 in which the reply devices comprise two or more reply coupons and a reply card.

10. The article of claim 9 in which the reply envelope contains at least one pocket adapted to receive a reply coupon and one pocket adapted to receive the reply card.

11. The article of claim 9 in which the reply envelope and the reply card are personalized.

12. The article of claim 1 in which the outer envelope also contains a plurality of separate printed enclosure sheets.

13. The article of claim 12 in which the reply devices are detachably connected to one of the separate enclosure sheets.

14. The article of claim 12 in which the reply envelope and at least one of the separate enclosure sheets are personalized.

15. The article of claim 1 in which the outer envelope also contains at least one separate printed enclosure sheet.

16. The article of claim 1 in which the reply envelope is personalized.

17. The article of claim 16 in which at least one of the reply devices is personalized.

* * * * *